US006950750B1

(12) United States Patent
Carpentier

(10) Patent No.: US 6,950,750 B1
(45) Date of Patent: Sep. 27, 2005

(54) METHOD OF ESTIMATING THE GAS/OIL RATIO (GOR) IN THE FLUIDS OF A WELL DURING DRILLING

(75) Inventor: Bernard Carpentier, Labbeville (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 79 days.

(21) Appl. No.: 10/646,888

(22) Filed: Aug. 25, 2003

(30) Foreign Application Priority Data

Aug. 28, 2002 (FR) ..... 02 10659

(51) Int. Cl.[7] ..... G01V 1/00
(52) U.S. Cl. ..... 702/11; 73/152.55; 436/31
(58) Field of Search ..... 702/11; 73/155, 73/152.55, 61.46, 152.19; 174/43; 436/139, 436/145, 31

(56) References Cited

U.S. PATENT DOCUMENTS 4,153,415 A 5/1979 Espitalie et al. ..... 436/31
4,352,673 A 10/1982 Espitalie et al. ..... 436/145
5,473,939 A * 12/1995 Leder et al. ..... 73/152.12
5,612,493 A * 3/1997 Alexander ..... 73/152.55
5,635,631 A 6/1997 Yesudas et al. ..... 73/61.46
5,843,787 A 12/1998 Trabelsi et al. ..... 436/139
6,229,086 B1 5/2001 Blanding ..... 174/43

* cited by examiner

*Primary Examiner*—John Barlow
*Assistant Examiner*—Victor J. Taylor
(74) *Attorney, Agent, or Firm*—Antonelli, Terry, Stout and Kraus, LLP.

(57) ABSTRACT

A method of evaluating the volume ratio of gas to oil (GOR) in the fluids of a well during drilling by direct or indirect measurement of the volumes of gas and oil in the cuttings. The method includes determining the volume of gas (Vg) contained in the drilling fluids by measuring a ratio between a volume of gas produced and a corresponding volume of drilled rock, determining the volume of oil (Vo) by measuring the total organic carbon (TOC) in the drilled rock while taking account of physical characteristics of the drilled rock and of the oil under the surface conditions, and determining said volume ratio (GOR) by calculating the ratio of the previously determined volumes of gas and of oil. The method can be implemented in the field, even on a drilling site, using a Rock-Eval type equipment for example.

3 Claims, 1 Drawing Sheet

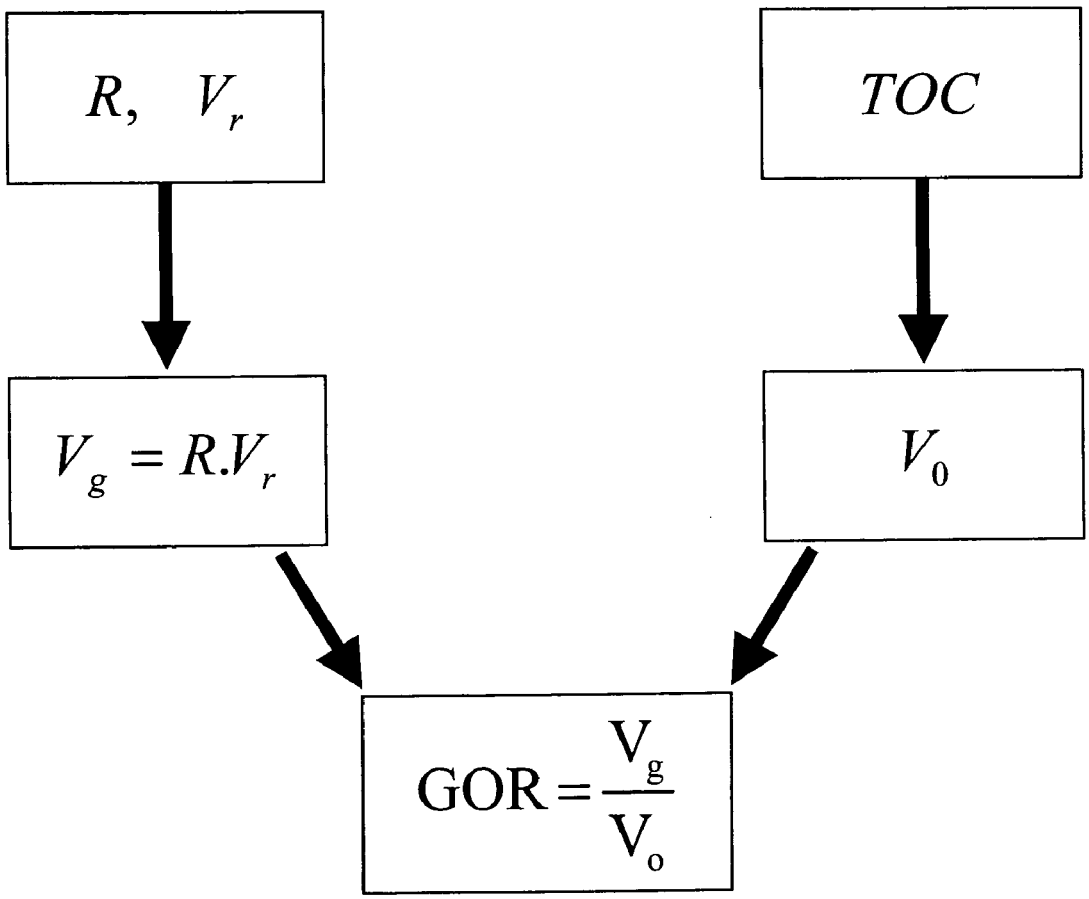
$R, \quad V_r$
$TOC$
$V_g = R.V_r$
$V_0$
$\mathrm{GOR} = \frac{V_g}{V_o}$

METHOD OF ESTIMATING THE GAS/OIL RATIO (GOR) IN THE FLUIDS OF A WELL DURING DRILLING

FIELD OF THE INVENTION

The present invention relates to a method of estimating the volume ratio of gas to oil in the fluids of a well during drilling, which is usually referred to as GOR (gas/oil ratio) by oilmen.

BACKGROUND OF THE INVENTION

A certain number of service companies have been measuring for a long time the gas content of mud (mud logging—measurement of the C1–C5 constituents) and some of these companies currently develop measuring tools allowing to quantify more precisely the gas content of mud, notably for the hydrocarbons of C6–C8 fractions.

In exploration as well as in development, when a hydrocarbon-rich level is discovered during drilling, it is very important for the operator to know the type of fluids present in the formation (oil, gas, condensate, heavy oil, etc.) or, even better, the volume ratio of gas to oil in the fluids of a well. This information is currently available only by means of formation tests, which requires drilling stop, as described in for example U.S. Pat. Nos. 5,635,631 and 5,612,493, and represents a considerable cost for the operator. It is therefore clear that an approximation of this GOR during drilling would be an important "plus" for the operator because this information would allow to better apprehend the economical interest of the potential deposit and would lead to a better evaluation of the rest of the drilling operation (drilling stop or continuation, absence or start of production tests).

In the present state of our knowledge, there is no method allowing to know this GOR without carrying out formation tests. There are only more or less empirical methods based on molecular ratios of the gases from the drilling mud whose interpretation allows, at best, to know if the fluid present in the reservoir is oil, gas or heavy oils.

SUMMARY OF THE INVENTION

The method according to the invention allows to evaluate, during drilling, the GOR in the field, even on the drilling site, by means of direct or indirect measurement of the volumes of gas and oil in the cuttings.

It essentially comprises:

- determining the volume of gas (Vg) contained in the drilling fluids by measuring a ratio between a volume of gas produced and a corresponding volume of drilled rock,
- determining the volume of oil (Vo) by measuring the total organic carbon (TOC) in the drilled rock while taking account of physical characteristics of the drilled rock and of the oil under the surface conditions, and
- determining said volume ratio (GOR) by calculating the ratio of the previously determined volumes of gas and of oil.

The ratio of a volume of gas produced at the surface to the same volume of drilled rock is for example evaluated by taking into account the gas concentration of the drilling fluids, the flow of circulating drilling fluids, a rate of penetration of the drill bit and the diameter of the borehole.

Other features and advantages of the method according to the invention will be clear from reading the description hereafter.

BRIEF DESCRIPTION OF THE DRAWING

The sole drawing FIGURE is a flow chart showing the method for estimating the volume ratio of gas to oil (GOR) in the fluids of a well during drilling according to the present invention.

DETAILED DESCRIPTION

It may be reminded that the GOR (gas/oil ratio) is defined by the relation GOR= $V_g/V_o$, where $V_g$ and $V_o$ are respectively the volumes of gas and of oil produced at the surface under standard conditions. The method is shown in the sole drawing FIGURE which is a flow chart showing basic steps of the method as follows.

Determination of $V_g$

The volume $V_g$ of gas contained in the drilling mud is estimated from measurements of the $V_g/V_r$ ratio (where $V_r$ is a drilled rock volume) provided by the operator. This ratio R of the $m^3$ of gas produced at the surface per $m^3$ of drilled rock is for example evaluated by means of the following information: gas concentration of the mud (in %), flow of mud ($m^3$/min), rate of penetration of the drill bit (minute/meter) and borehole diameter.

From this value R, we can calculate:

$$V_g = R * V_r$$

Determination of the Volume of $V_o$

We propose an estimation of the volume of oil $V_o$ by using measurements performed in the field, even on the drilling site, by means of an analysis method and tool of Rock-Eval type for example, from cuttings.

This method, which allows, in the case of a hydrocarbon reservoir, to quantify the total organic carbon (TOC) present in a rock sample, is described and implemented for example in the following patents filed by the applicant: FR-2,722,296 (U.S. Pat. No. 5,843,787), FR-2,786,568, FR-2,472,754 (U.S. Pat. No. 4,352,673) or U.S. Pat. No. 4,153,415 as regards the Rock-Eval technique.

This total organic carbon (TOC) expressed in % by weight of carbon in relation to the rock allows to evaluate (by considering average densities for the liquid hydrocarbon phase and for the rock) the % by volume of hydrocarbons present in an analyzed rock sample.

Considering that the sample is taken at the pressure and at the temperature prevailing at the surface, one may consider that only the liquid fraction of the reservoir fluid is present in the cuttings. The volume of oil $V_o$ is therefore directly determined from the Rock-Eval analysis with the relation:

$$V_o = \frac{TOC}{100} \cdot k \cdot \frac{\rho_r}{\rho_o} \cdot V_r \text{ where}$$

- $\rho_o$ is the density of the liquid hydrocarbon at the surface (generally estimated at 0.8),
- $\rho_r$ is the rock density estimated using the relation $\rho_r = \rho_{ro}(1-\phi) + \rho_o \cdot \phi$, where $\rho_{ro}$ is the matrix density (2.8 for a dolomite, 2.71 for a limestone, 2.65 for a sandstone),
- $\phi$ is the porosity of the rock, and
- k is the ratio between % by weight of hydrocarbons and % by weight of carbon (generally estimated at 1.2).

Evaluation of the GOR

It is based on the calculation of $V_g/V_o$:

$$GOR = \frac{V_g}{V_o} = \frac{R \cdot V_r}{\frac{TOC}{100} \cdot k \cdot \frac{\rho_r}{\rho_o} \cdot V_r} \quad \text{hence:}$$

$$GOR = \frac{R}{\frac{TOC}{100} \cdot k \cdot \frac{\rho_r}{\rho_o}}$$

What is claimed is:

1. A method of estimating the volume ratio of gas to oil (GOR) in the fluids of a well during drilling, characterized in that it comprises:

determining the volume of gas (Vg) contained in the drilling fluids by measuring a ratio between a volume of gas produced and a corresponding volume of drilled rock, determining the volume of oil (Vo) by measuring the total organic carbon (TOC) in the drilled rock while taking account of physical characteristics of the drilled rock and of the oil under the surface conditions, and determining said volume ratio (GOR) by calculating the ratio of the previously determined volumes of gas and of oil.

2. A method as claimed in claim 1, characterized in that the ratio of a volume of gas produced at the surface to the same volume of drilled rock is evaluated by taking into account the gas concentration of the drilling fluids, the flow of circulating drilling fluids, a rate of penetration of the drill bit and the diameter of the borehole.

3. A method as claimed in claim 1, characterized in that said volume ratio (GOR) is determined by the relation:

$$GOR = \frac{R}{\frac{TOC}{100} \cdot k \cdot \frac{\rho_r}{\rho_o}}$$

where:

$\rho_o$ is the density of the liquid hydrocarbon at the surface (generally estimated at 0.8), $\rho_r$ is the estimated rock density, R is the measured ratio of the volume of gas produced at the surface per volume of drilled rock, and k is the ratio between % by weight of oil and of carbon in the drilled rock.

* * * * *